United States Patent [19]

Harumatsu

[11] Patent Number: 4,693,620

[45] Date of Patent: Sep. 15, 1987

[54] VARIABLE WIDTH PAPER FEEDER FOR PERFORATED AND UNPERFORATED PAPER

[75] Inventor: Masatoshi Harumatsu, Tamayama, Japan

[73] Assignee: Alps Electric Co.,Ltd., Japan

[21] Appl. No.: 771,888

[22] Filed: Sep. 3, 1985

[30] Foreign Application Priority Data

Aug. 31, 1984 [JP] Japan ..... 59-132182[U]

[51] Int. Cl.[4] ..... B41J 11/30

[52] U.S. Cl. ..... 400/611; 400/616.1; 400/636; 226/74; 226/82

[58] Field of Search ..... 400/605, 606, 607, 608, 400/608.1, 608.2, 616, 616.1, 616.2, 616.3, 636; 226/74, 76, 79, 82, 83, 84, 85

[56] References Cited

U.S. PATENT DOCUMENTS

| | | | |
|---|---|---|---|
| 1,425,907 | 8/1922 | Sherman | 400/616.3 X |
| 1,972,555 | 9/1934 | Fear | 226/79 X |
| 2,280,095 | 4/1942 | Metzner | 400/616.3 X |
| 3,549,068 | 12/1970 | Calano | 400/616.3 X |
| 3,917,048 | 11/1975 | Riley | 400/636 X |
| 3,972,460 | 8/1976 | Kesinger et al. | 400/616.3 X |

FOREIGN PATENT DOCUMENTS

| | | | |
|---|---|---|---|
| 3141458 | 9/1983 | Fed. Rep. of Germany | 400/616.2 |
| 0163589 | 10/1982 | Japan | 400/636 |
| 0017044 | 2/1983 | Japan | 226/76 |

*Primary Examiner*—Ernest T. Wright, Jr.
*Attorney, Agent, or Firm*—Guy W. Shoup

[57] ABSTRACT

A paper feeder for a printer having a platen and a printing member disposed in confronting relation to the platen includes a pair of slide blocks which can be moved to vary the spacing therebetween dependent on the width of recording paper placed on the platen, each of the slide blocks supporting a track rotating body having a plurality of pins mounted on a peripheral surface thereof and spaced at prescribed intervals, a paper holder member confronting the track rotating body, and a drive roller. A drive shaft is disposed in each of the slide blocks for driving the track rotating body and the drive roller. A roller shaft supports thereon a pair of pinch rollers for contacting the drive rollers, respectively, and is movable away from the slide blocks, the pinch rollers being held by the paper holder members for slidable movement along the roller shaft in response to movement of the slide blocks.

5 Claims, 6 Drawing Figures

VARIABLE WIDTH PAPER FEEDER FOR PERFORATED AND UNPERFORATED PAPER

BACKGROUND OF THE INVENTION

The present invention relates to a printer, and more particularly to a paper feeder capable of feeding many types of recording paper and of reliably feeding all of the many types of recording paper.

Various types of recording paper are used on printers such as wire dot-matrix printers.

FIG. 3 of the accompanying drawings illustrates a continuous paper Sa known as a fan-fold stack. The continuous paper Sa has feed holes P called perforations defined in each edge thereof at prescribed intervals. FIG. 4 shows a roll of paper Sb which does not have the feed holes P.

FIG. 5 shows a conventional printer which uses the unperforated roll of paper Sb. In this printer, the roll paper Sb is inserted from behind a base 1 and rolled around a cylindrical platen 2 from below the same. The paper Sb is held against the platen 2 by means of rollers 5 mounted on a paper holder shaft 4. The platen 2 has a shaft 3 rotated by any suitable drive mechanism such as a stepping motor (not shown) for vertically feeding the paper Sb sandwiched between the platen 2 and the rollers 5 in response to rotation of the platen 2. A carriage 7 is slidably mounted on a carriage guide shaft 6 extending parallel to the platen 2, and supports thereon a printing member 8 such as a wire dot-matrix head or a thermal head. The printing member 8 is disposed in confronting relation to the roll paper Sb rolled around the platen 2. Power from the stepping motor (not shown) is transmitted to the carriage 7 through a wire or the like to move the carriage 7 and the printing member 8 on the guide shaft 6 in a direction along the platen 2 for effecting desired printing operation.

The printer shown in FIG. 5 is disadvantageous however because the paper feed operation lacks reliability when the paper Sb is fed along under the pressure which it is subject to, sandwiched between the platen 2 and the pinch rollers 5. More specifically, paper feed pitches may be subjected to slight variations due to any error in the diameter of the platen 2 and slippage between the paper Sb and the platen 2. Where the paper Sb is ruled and characters are to be printed along the ruled lines, the line feed pitches tend to be out of alignment with the intervals of the ruled lines as the platen 2 rotates.

The continuous perforated paper Sa shown in FIG. 3 is more suitable for printing on the ruled lines. In case the continuous paper Sa is used, it is necessary to employ a special dedicated arrangement in which paper feed pins are mounted on the platen 2 or an arrangement shown in FIG. 6 in which a tractor feed mechanism is added to the arrangement of FIG. 5.

The tractor feed mechanism denoted by numeral 10 in FIG. 6, is attached upwardly and slightly rearwardly of the platen 2. The tractor feed mechanism 10 has side frames 11*a*, 11*b* and a pair of shafts 12, 13 extending parallel to each other between the side frames 11*a*, 11*b*. One of the shafts 13 is rotatably driven by a stepping motor (not shown). Blocks 14*a*, 14*b* are mounted respectively on opposite ends of the shafts 12, 13 and spaced a given distance from each other, with a belt 15 wound around each of the blocks 14*a*, 14*b*. The belt 15 is formed of a resilient material such as rubber or silicone and has a plurality of pins 15*a* disposed on a peripheral surface thereof at regular pitches equal to those of the feed holes P in the continuous paper Sa. Rotation of the shaft 13 driven by the stepping motor is transmitted to the belt 15 to rotate the same at a prescribed speed around each of the blocks 14*a*, 14*b*.

The continous paper Sa is fed from behind the base 1 into a position below the platen 2 and then rolled around the platen 2. The feed holes P in the continuous paper Sa are fitted over the pins 15*a* on the belts 15. Paper holder plates 16 (one shown) are mounted respectively on the blocks 14*a*, 14*b* for preventing the continous paper Sa from being detached from the blocks 14*a*, 14*b*. The paper holder shaft 4 is pulled toward the front of the base 1 for separating the rollers 5 off the platen 2. During printing operation, the carriage 7 is moved laterally and the printing member 8 is operated to record desired characters on the continuous paper Sa. For line feeding operation, the shaft 13 is driven by the stepping motor to rotate the belts 15. The continuous paper Sa is now fed along accurately by the pins 15*a* on the belts 15.

The conventional printer shown in FIG. 5 allows only the roll paper Sb or separate sheets to be used thereon, but does not permit the continuous perforated paper Sa as shown in FIG. 3 to be employed. If it is desired to use the continuous paper Sa on the printer of FIG. 5, then it is necessary to add the tractor feed mechanism 10 as illustrated in FIG. 6. The resultant construction of the combined device is complex. Furthermore, it involves an expenditure of time and labor to attach and detach the tractor feed mechanism 10. On the other hand, a printer originally equipped with the tractor feed mechanism 10 cannot use the roll paper Sb or plain separate sheets thereon.

SUMMARY OF THE INVENTION

With the prior problems in view, it is an object of the present invention to provide a paper feeder for printers which is simple in construction, capable of using all types of paper such as roll paper, separate sheets, and continuous perforated paper, capable of freely varying the width of the paper feed mechanism to adapt to the width and type of paper used, and has a simple construction.

According to the present invention, there is provided a paper feeder for a printer having a platen and a printing member disposed in confronting relation to the platen, comprising a pair of slide blocks which can be moved to vary the spacing therebetween, each of the slide blocks supporting a track rotating body having a plurality of pins which are mounted on a peripheral surface thereof and spaced at prescribed intervals, a paper holder member confronting the track rotating body, and a drive roller; a drive shaft disposed in each of the slide blocks for driving the tractor rotating body and the drive roller; and a roller shaft supporting thereon a pair of pinch rollers for contacting the drive rollers, respectively, and movable away from the slide blocks, the pinch rollers being held by the paper holder members for slidable movement along the roller shaft in response to movement of the slide blocks.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
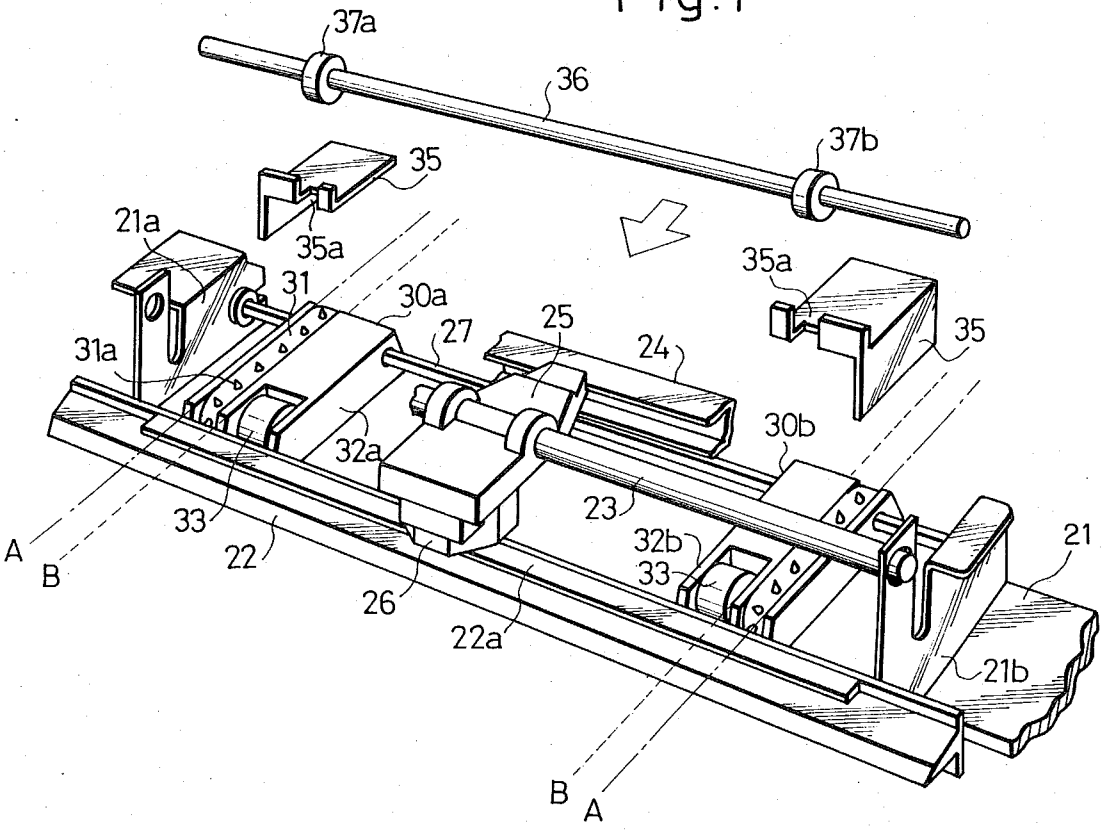
FIG. 1 is a perspective view of a principal portion of a printer according to the present invention.

The present invention will be described with reference to FIGS. 1 and 2.

A platen 22 formed of hard rubber for example extends between a pair of righthand and lefthand side plates 21*a*, 21*b* of a base 21. A sheet of flexible synthetic resin 22*a* is bonded to an upper surface of the platen 22 for bearing recording paper Sa or Sb thereon.

A carriage guide 23 and a guide frame 24 extend parallel to each other between the side plates 21*a*, 21*b*, and a carriage 25 is movably mounted on the carriage guide 23 and guided by the guide frame 24. The carriage 25 can be moved along the platen 22 by power transmitted thereto through a wire or the like from a stepping motor (not shown). The carriage 25 supports thereon a printing member 26 such as a wire dot-matrix head or a thermal head. The printing member 26 has a printing face directed downwardly in confronting relation to the sheet 22*a* on the platen 22.

A drive shaft 27 extends and is rotatably supported between the side plates 21*a*, 21*b*, and is rotatably drivable by a stepping motor (not shown). The drive shaft 27 supports thereon a pair of slide blocks 30*a*, 30*b*. As illustrated in FIG. 2, each of the slide blocks 30*a*, 30*b* has on a distal end thereof a projection 30*c* slidably fitted in a guide groove 22*b* defined in an inner side surface of the platen 22. The slide blocks 30*a*, 30*b* are slidable along the drive shaft 27 and guided by the guide groove 22*b* for changing an interval between the slide blocks 30*a*, 30*b*. There is a fixing mechanism of any suitable type, such as a screw 27*a*, for example, disposed between the slide blocks 30*a*, 30*b* and the drive shaft 27 for fixing the slide blocks 30*a*, 30*b* with respect to the drive shaft 27 when the desired interval between the slide blocks 30*a*, 30*b* is established.

Figure 2:
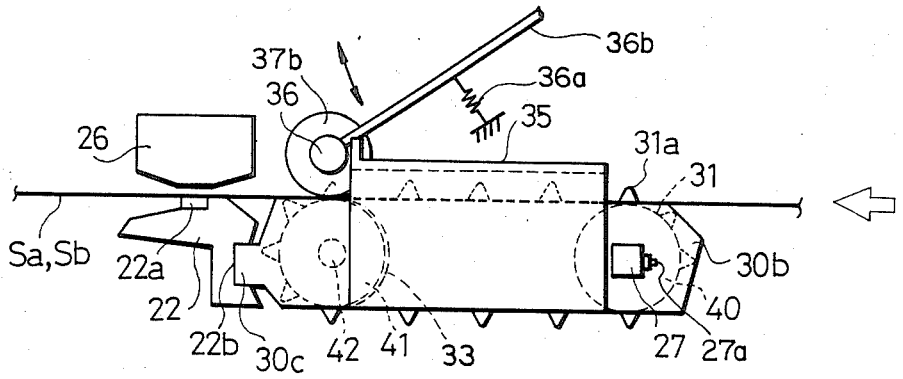
FIG. 2 is a side elevational view of a paper feeder in the printer.

As shown in FIG. 2, each of the slide blocks 30*a*, 30*b* accommodates therein a drive pulley 40 and a driven pulley 41. The drive pulley 40 is splined to the drive shaft 27 for being driven thereby. The driven pulley 41 is secured to a driven shaft 42 rotatably supported in its respective slide block 30*a*, 30*b*. A belt 31 of a resilient material is trained around the drive pulley 40 and the driven pulley 41 and is rotatable on the peripheral surface of the slide blocks 30*a*, 30*b* in response to rotation of the drive shaft 27. The belt 31 has on an outer peripheral surface a plurality of pins 31*a* spaced at regular intervals or pitches, the belt 31 serving as a tractor rotating body. The pitchs of the pins 31*a* are equal to those of the feed holes P in the continuous paper Sa shown in FIG. 3.

Plates 32*a*, 32*b* are integrally formed respectively with confronting surfaces of the slide blocks 30*a*, 30*b*. Drive rollers 33 are interposed between the blocks 30*a*, 30*b* and the plates 32*a*, 32*b*. The drive rollers 33 are integral with the driven shafts 42, respectively, for synchronous rotation with the driven pulleys 41 on which the belts 31 are trained.

Paper holder members 35 are mounted respectively on the slide blocks 30*a*, 30*b*. The paper holder members 35 are of an L-shaped coss section for being easily fixed to the slide blocks 30*a*, 30*b*. When the paper holder members 35 are fixed to the slide blocks 30*a*, 30*b*, the paper holder members 35 are disposed in confronting relation to the pins 31*a* with a slight clearance left therebetween.

A roller shaft 36 extends between the side plates 21*a*, 21*b*, and a pair of pinch rollers 37*a*, 37*b* are axially slidably supported on the roller shaft 36 and rotatable about their own axes. The roller shaft 36 is normally urged by a spring 36*a* to move in a direction toward the slide blocks 30*a*, 30*b* for pressing the pinch rollers 37*a*, 37*b* resiliently against the drive rollers 33. The roller shaft 36 has an integral lever 36*b* which can be manipulated by the operator to a detent position to lock the pinch rollers 37*a*, 37*b* in a position away from the drive rollers 33. The pinch rollers 37*a*, 37*b* are fitted in slots 35*a* defined respectively in the paper holder members 35, so that the pinch rollers 37*a*, 37*b* and the slide blocks 30*a*, 30*b* can be moved together in a direction transversely across the recording paper Sa, Sb.

Operation of the printer thus constructed will be described.

Figure 3:
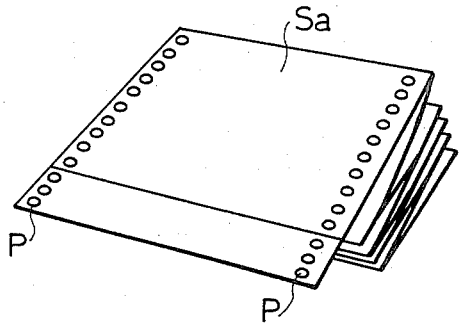
FIG. 3 is a perspective view of continuous paper.

The recording paper Sa, Sb is inserted into a gap between the slide blocks 30*a*, 30*b* and the paper holder members 35 in the direction of the arrow and is loaded on the platen 22.

Where the recording paper is the continuous paper (fan-fold stack) Sa having the feed holes (perforations) P as shown in FIG. 3, the side edges of the paper Sa are located at positions indicated by the dot-and-dash lines A in FIG. 1, and the pins 31*a* on the belts 31 are fitted in the feed holes P. If the interval between the slide blocks 30*a*, 30*b* is not equal to the width of the paper Sa, then the slide blocks 30*a*, 30*b* can be moved along the drive shaft 27 and the guide groove 22*b* into an optimum position. At this time, the lever 36*b* is actuated to lock the roller shaft 36 away from the slide blocks 30*a*, 30*b* so that no pressure from the pinch rollers 37*a*, 37*b* will act on the continuous paper Sa.

Figure 4:
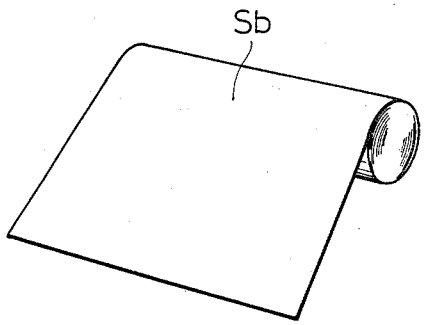
FIG. 4 is a perspective view of roll paper.
Figure 5:
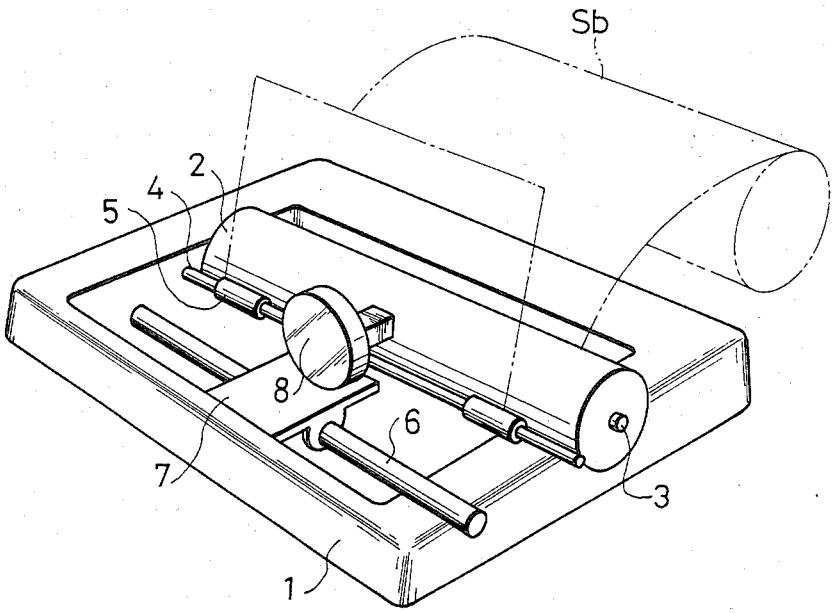
Fig. 5 PRIOR ART
FIGS. 5 and 6 are perspective views of principal portions of conventional printers.
Figure 6:
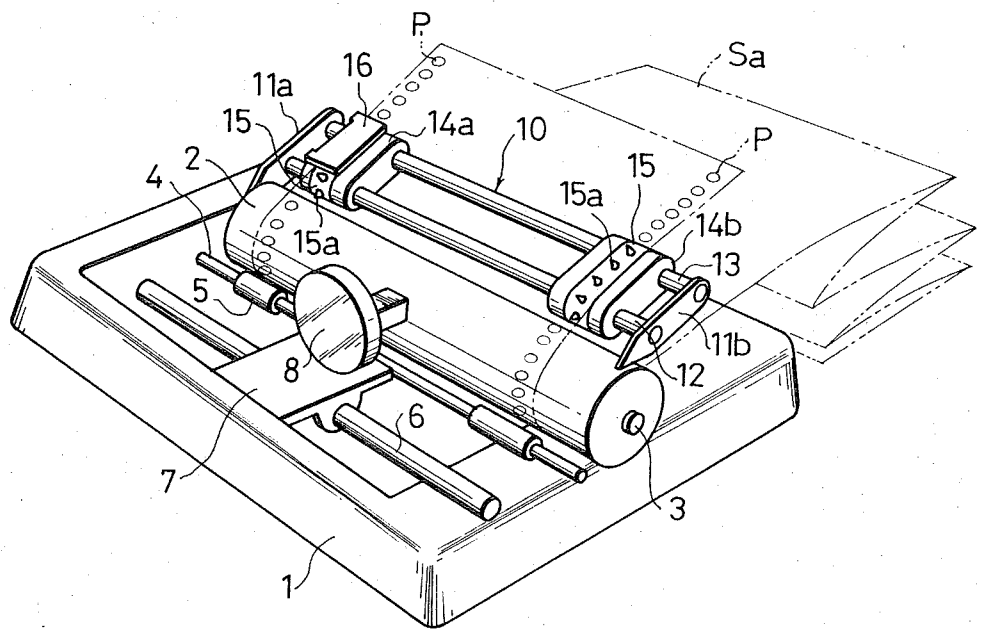
Fig. 6 PRIOR ART

For printing operation, the carriage 25 is driven by the stepping motor to move along the carriage guide shaft 23 and the guide frame 24. During such movement, the printing member 26 is actuated to record desired characters on the continuous paper Sa placed on the sheet 22*a* on the platen 22. After one line of characters has been printed, the drive shaft 27 is driven by the stepping motor to rotate the belts 31 to enable the pins 31*a* to feed the continuous paper Sa in a one-line increment.

Where the roll paper Sb as shown in FIG. 4 or separate sheets are used, the interval between the slide blocks 30*a*, 30*b* is selected such that the edges of the roll paper Sb or the sheet will be located in positions indicated by the dotted lines B in FIG. 1 bearing on the drive rollers 33. With the roll paper Sb or separate sheets, the roller shaft 36 is not locked, but the pinch rollers 37*a*, 37*b* are pressed against the drive rollers 33 under the spring force to cause the pinch rollers 37*a*, 37*b* and the drive rollers 33 to grip the opposite edges of the paper Sb. For feeding the paper Sb, the drive shaft 27 is rotated about its own axis to cause the drive pulleys 40, the belts 31, the driven pulleys 41, and the driven shafts 42 to drive the drive rollers 33 for thereby feeding the paper Sb. Printing operation is the same as described above. As known conventionally, one or more stepping motors may be used for the above-described functions of the printer. It is of course preferred that one stepping motor be used, when provided with the appropriate linkages and controls to accomplish the multiple functions. For the invention, it is only important that there be some drive source for rotating the drive shaft 27 for the tractor rotating body 31 and drive roller 33.

While in the illustrated embodiment the tractor rotating body comprises the belt 31 having the pins 31*a*, it may comprise a roller having pins on its circumference.

The present invention has the following advantages:

(1) Since the slide blocks 30*a*, 30*b* are positioned on opposite sides of the recording paper Sa, Sb and have a paper feed mechanism composed of the tractor feed mechanism and the ordinary drive rollers 33, the printer can use continuous paper Sa having feed holes P defined in opposite edges, roll paper Sb with no such feed holes, and separate sheets. The printer can be used in a wider application as many types of paper can be fed along under the same condition during printing operation.

(2) Inasmuch as the distance between the slide blocks 30*a*, 30*b* can be varied, the paper feeder can freely be adapted to the width of any continuous or roll paper Sa, Sb used.

(3) Since the pinch rollers 37*a*, 37*b* held by the paper holder members 35, 35 can be moved to align with the slide blocks 30*a* and 30*b*, no complex mechanism is required for establishing the interval between the pinch rollers 37*a*, 37*b*, and the overall mechanism can be simplified.

(4) The pair of pinch rollers 37*a*, 37*b* is supported on the common roller shaft 36, and the roller shaft 36 can be moved away from the slide blocks 30*a*, 30*b* for separating the pinch rollers 37*a*, 37*b* simultaneously from the drive rollers 33. The printer can be operated with ease when using the continuous paper Sa, Sb.

Although a certain preferred embodiment has been shown and described, it should be understood that many changes and modifications may be made therein without departing from the scope of the appended claims.

What is claimed is:

1. A paper feeder capable of feeding both a paper of the type having perforated edges by engaging the perforations of the edge of the perforated paper and a paper of the type having unperforated edges by engaging the surface of the unperforated paper, comprising:

a pair of slide blocks adjustably slidable along a drive shaft extending in a first horizontally defined direction so as to vary the spacing between the slide blocks in accordance with the width and type of paper to be engaged by said slide blocks;

each slide block extending in a second horizontal direction normal to the first direction and having a pair of opposite vertical side walls extending in the second direction, wherein the paper is fed along a feed path in a horizontal paper feeding direction parallel to the second direction, a track rotating body mounted between said side walls at an outside location of said slide block on whose peripheral surface there is provided a plurality of pins for engaging the perforations of the perforated type of paper, a drive roller mounted between said side walls at an inside location of said slide block which has a frictional surface for engaging the unperforated type of paper, and drive means in said slide block for engaging said drive shaft and driving said track rotating body and drive roller in rotation so as to drive the corresponding type of paper engaged therewith in the paper feeding direction;

a pair of holder members each mounted on a respective slide block and having a portion extending over the paper feed path formed with a pinch roller holding portion which is aligned for holding a pinch roller in position for contact with the drive roller of the respective slide block; and a pair of pinch rollers mounted adjustably slidably on a roller shaft which is movable toward said slide blocks so as to bring said pinch rollers into engagement with the holding portions of the respective holder members and into frictional contact with the respective drive rollers, wherein said slide blocks can be adjustably moved in said first direction to vary the spacing therebetween and said pinch rollers, engaged with the respective holding portions of said holder members, can be adjustably moved with said slide blocks in said first direction so as to remain in positions of frictional contact with said drive rollers mounted in said slide blocks.

2. A paper feeder according to claim 1, wherein each of said slide blocks accommodates therein a drive pulley mounted on said drive shaft, a driven shaft supporting said drive roller, and a driven pulley mounted on said driven shaft, said track rotating body comprising a belt trained around said drive and driven pulleys.

3. A paper feeder according to claim 1, wherein each of said holder members has an L-shaped cross section and wherein said pinch roller holding portion includes a slot holding one of said pinch rollers therein.

4. A paper feeder according to claim 1 for use in a printer having a platen disposed horizontally downstream in the paper feeding direction from said slide blocks, and a print head positioned vertically above and movable translationally in said first direction along said platen, whereby the respective types of paper engaged by said drive rollers and track rotating bodies are fed horizontally along said paper feed path in between said platen and said print head.

5. A paper feeder according to claim 4, wherein said platen has a guide groove formed on a side facing said slide blocks, and said slide blocks each have end portions engaged in said guide groove for guiding the adjustable sliding movement of said slide blocks.

* * * * *